United States Patent [19]

Priel

[11] 4,277,739

[45] Jul. 7, 1981

[54] FIXED VOLTAGE REFERENCE CIRCUIT

[75] Inventor: Ury Priel, Cupertino, Calif.

[73] Assignee: National Semiconductor Corporation, Santa Clara, Calif.

[21] Appl. No.: 44,833

[22] Filed: Jun. 1, 1979

[51] Int. Cl.[3] ..... G05F 1/58

[52] U.S. Cl. ..... 323/313; 323/314; 323/907

[58] Field of Search ..... 323/1, 4, 8, 16, 19, 323/22 T; 307/296 R, 297

[56] References Cited

U.S. PATENT DOCUMENTS

| | | | |
|---|---|---|---|
| 3,781,648 | 12/1973 | Owens | 323/4 |
| 3,893,018 | 7/1975 | Marley | 323/19 |
| 4,017,788 | 4/1977 | Stepp et al. | 323/22 T |
| 4,088,941 | 5/1978 | Wheatley, Jr. | 323/19 X |

*Primary Examiner*—William M. Shoop
*Assistant Examiner*—Peter S. Wong
*Attorney, Agent, or Firm*—Gail W. Woodward; James A. Sheridan

[57] ABSTRACT

Two output voltages are generated in response to the output of a power supply. One output is referenced to the positive supply terminal $V_{CC}$ and the other output is referenced to the negative supply terminal $V_{EE}$. A first $\Delta V_{BE}$ reference circuit provides for the production of the pair of voltages which are temperature compensated. A second $\Delta V_{BE}$ reference circuit operates a voltage regulator which supplies the first $\Delta V_{BE}$ reference. The resulting two output voltages are temperature compensated and substantially independent of power supply voltage variations.

8 Claims, 6 Drawing Figures

FIXED VOLTAGE REFERENCE CIRCUIT

BACKGROUND OF THE INVENTION

The invention relates to a circuit that supplies a pair of voltages particularly suitable for operating emitter coupled logic (ECL) circuitry. One voltage typically biases the ECL current sources and is referenced against $V_{EE}$, the negative power supply terminal. The other voltage is used as the switching threshold level and is referenced against the positive power supply terminal, $V_{CC}$. As a practical matter ECL circuits have relatively small voltage swings and must operate in the presence of variable supply voltages and noise that is certain to be present to some degree. One measure of the excellence of an ECL system is its noise immunity and tolerance to supply voltage variations. In one sense the ideal system would provide the two voltages referenced respectively to the + and − supply terminals in such a manner that they do not vary with either loading conditions or temperature. Additionally they will not vary with variations in the power supply voltage. As a practical matter these conditions can be approached. If desired, the two voltages can be made to have a controlled temperature that is tailored to suit the ECL system requirement.

U.S. Pat. No. 3,893,018 to Robert R. Marley shows an approach to ECL power supplies and one embodiment will be described in detail hereinafter. While the circuit provides useful ECL operation, the noise margins and supply variation tolerance leave considerable room for improvement.

SUMMARY OF THE INVENTION

It is an object of the invention to provide an ECL power supply control circuit that is insensitive to power supply variations and has a low and well-controlled temperature coefficient.

It is a further object of the invention to provide an ECL bias and reference potential circuit that is capable of improving noise margins and has a low and well-controlled temperature coefficient of voltage.

It is a still further object of the invention to provide supply-independent bias and threshold voltages useful in ECL systems and having a low and well-controlled temperature coefficient of voltage with the capability of slaving a plurality of output supply circuits thereto.

These and other objects are achieved using the following configuration. A $\Delta V_{BE}$ generator is supplied with bias current so that a voltage having a positive temperature coefficient is produced. This voltage is magnified in a series connected ratioed first resistor and combined with the drop across a forward biased PN junction that develops a negative temperature coefficient voltage. When the combined voltages are made substantially equal to the silicon band gap extrapolated to absolute zero (about 1.3 volts), the resultant voltage has substantially zero temperature coefficient. The combination can be made to have either a positive or negative temperature coefficient of voltage as desired. This voltage is desirably referenced against the negative power supply terminal using NPN transistors. The current flowing in the $\Delta V_{BE}$ generator is returned to the positive power supply using a second ratioed series connected resistor which also develops a positive temperature coefficient voltage. This is combined with the drop across a second forward biased PN junction which provides a series connected negative temperature coefficient voltage. In this case the combined voltages have a low or zero temperature coefficient and are referenced to the positive power supply terminal. A second $\Delta V_{BE}$ generator is used to develop a second reference voltage that is used to control a regulated internal power supply which in turn provides a constant current to both $\Delta V_{BE}$ references. The regulated power supply therefore has a zero or low temperature coefficient and the two output voltages are independent of the power supply voltage. In addition a plurality of slaved output circuits can be employed where isolated ECL circuits are to be operated from a single supply. Finally if desired, the second $\Delta V_{BE}$ reference and the regulated power supply can be operated from a third $\Delta V_{BE}$ reference and voltage regulator which further reduces power supply voltage sensitivity.

DESCRIPTION OF THE PRIOR ART

Figure 1:
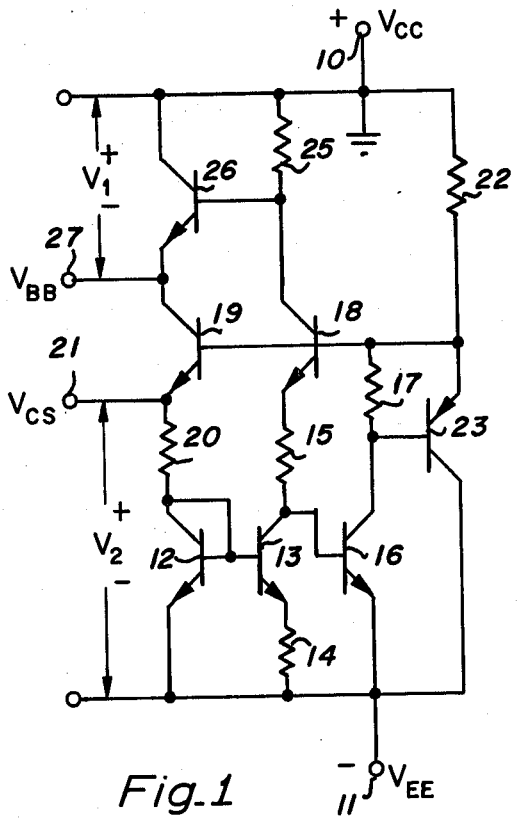
FIG. 1 is a schematiic diagram of a prior art circuit.

In FIG. 1 the prior art circuit is shown. As is typical in emitter coupled logic practice the positive supply rail 10 is grounded while $V_{EE}$ is applied to terminal 11 at the negative rail. The heart of the circuit is a $\Delta V_{BE}$ generator circuit. Transistors 12 and 13 are operated at different emitter current densities so that their base to emitter voltage ($V_{BE}$) values are different. If transistor 12, which is diode connected, is operated at the higher current density, its $V_{BE}$ will exceed that of transistor 13 and the difference $\Delta V_{BE}$ will appear across resistor 14. This voltage has a linear positive temperature coefficient and falls to zero at absolute zero. The actual value of $\Delta V_{BE}$ is found in the following relation:

$$\Delta V_{BE}=(kT/q)\ ln(J1/J2) \quad (1)$$

where:

k is boltzman's constant

T is the absolute temperature q is the charge on an electron

J1/J2 is the current density ratio in the two transistors.

Since resistor 15 passes the same current as resistor 14, it will develop a voltage that is related to $\Delta V_{BE}$ by the ratio of resistor 15 to resistor 14.

The collector of transistor 13 is directly coupled to the base of transistor 16 so that the $V_{BE}$ of transistor 16 is in series with the voltage across resistor 15. Transistor 16 acts as an error amplifier and its collector is coupled to the base of transistor 18, the emitter of which couples back to resistor 15 to act as the supply for transistor 13. This is a negative feedback amplifier system which will stabilize the voltage across resistor 14 at $\Delta V_{BE}$. Transistor 19 has its base driven in parallel with that of transistor 18 so that the potential at the emitter of transistor 19 is the same as the potential at the emitter of transistor 18. If resistor 20 matches resistor 15, the currents in transistors 12 and 13 are equal. This means that the current density difference in transistors 12 and 13 will be due entirely to their area differences. This geometrical relationship can be relatively precisely controlled in IC manufacture.

As an easily recognized approximation of equation (1) if the area of transistor 13 is ten times that of transistor 12, at about 300° K. the voltage across resistor 14 will be about 60 mv with a coefficient of about 0.2 mv/degree. At 300° K. the temperature coefficient of a typical junction diode will be about −2 mv/degree. Thus, if resistor 15 is made about ten times the value of resistor 14, it will develop a voltage with a +2 mv/degree so as to substantially match the diode coefficient. For these conditions the potential at the emitter of transistor 18 will be close to 1.3 volts, the extrapolated band gap potential of silicon at absolute zero.

From the above it can be seen that a regulated temperature compensated potential $V_{CS}$ is available at terminal 21. The voltage $V_2$ is about 1.3 volts referenced to $V_{EE}$.

It will be noted that the collector of transistor 16 is returned to ground through resistor 17 and resistor 22. Ordinarily this would result in circuit operating variations due to variations in supply voltage. However, transistor 23, which is a conventional substrate connected PNP transistor, acts as a shunt regulator. As the $V_{CC}$ to $V_{EE}$ difference increases so as to increase the current in resistor 22 and hence resistor 17, transistor 23 will conduct more heavily and shunt current around resistor 17 thereby reducing the potential variations at the base of transistor 18. This means that $V_2$ will be independent of temperature and of reduced dependency on supply voltage.

The circuit also contains resistor 25 which completes the collector circuit of transistor 18 to ground. If resistor 25 is made equal to resistor 15, it will develop a similar voltage that has a positive temperature coefficient and emitter follower 26 couples this voltage to $V_{BB}$ terminal 27. Thus, the $V_{BE}$ of transistor 26 is coupled in series with the voltage across resistor 25. This means that $V_{BB}$ at terminal 27 is $V_1$ referenced to $V_{CC}$. For the above described conditions $V_1$ will also be a regulated temperature compensated 1.3 volts.

While the circuit of FIG. 1 is operative and useful, it does not fully solve the problems it addresses. For example, the substrate PNP transistor 23 provides a relatively uncontrolled current gain characteristic. Also the shunted current is a function of $R_{17}$ and the $V_{BE}$ of transistor 23. The resistor has a positive temperature coefficient and the $V_{BE}$ has a negative one, resulting in wide variations in the shunted current as a function of temperature as well as processing parameters. As a practical matter, power supply voltage variations will produce variations in the collector current of transistor 16. This in turn will vary the $V_{BE}$ of transistor 16 and thereby vary both $V_1$ and $V_2$.

DESCRIPTION OF THE INVENTION

In the discussion to follow it is intended that the circuit be constructed in integrated circuit (IC) form using conventional silicon monolithic bipolar device fabrication. In this form of construction NPN transistors can be fabricated to typical Beta values in excess of 200. Accordingly, the transistor base current values will be less than 0.5% of the collector current. In the following discussion, the base current effects can be ignored in the first order evaluation. In the circuits of the invention only NPN transistors are present. The emitter base diodes thus produced have good accord with well-known theoretical considerations. They match each other, are predictable in performance, and are reliable in operation. It should also be noted that while precise resistor values are difficult to achieve in IC processing, resistor ratio values can be achieved to a much better accuracy. The circuits to be described can, if desired, be incorporated directly into the ECL circuit chips and this configuration provides temperature tracking. However, if desired, the supply chips can be on separate IC chips.

Figure 2:
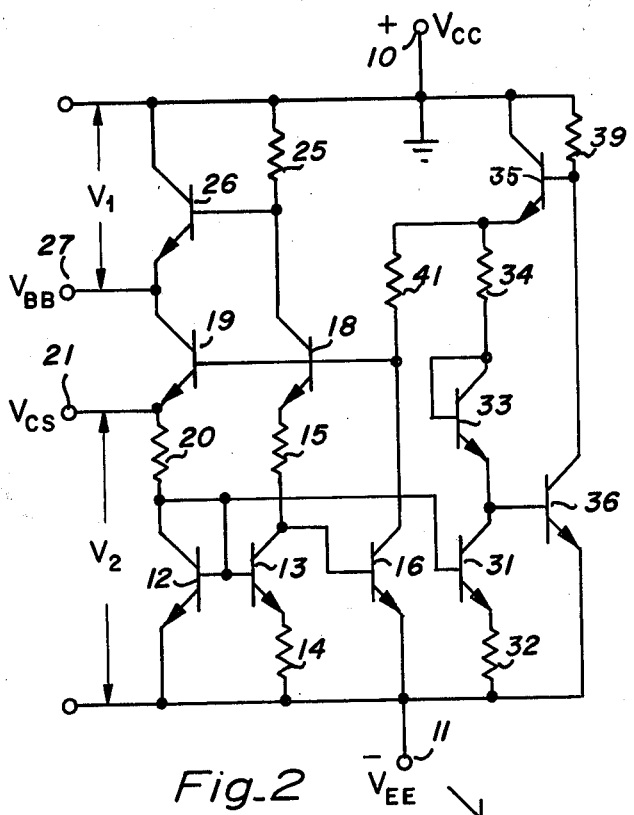
FIG. 2 is a schematic diagram of the basic circuit of the invention.

FIG. 2 illustrates the improved circuit of the invention. Where the parts involved are similar to those of FIG. 1 the same designations are used and the functions thereof are the same.

In this circuit one of the primary objects is to maintain a constant current in transistor 16. While other circuits could be used, a voltage regulator is employed for this function. A second $\Delta V_{BE}$ generator is employed in the form of transistor 31 which has its base directly coupled to that of transistor 12. If transistor 31 is operated at the lower current density, $\Delta V_{BE}$ between transistors 12 and 31 will appear across resistor 32. The collector of transistor 31 is returned to $V_{CC}$, through diode 33, resistor 34, and transistor 35. The base of transistor 36 is tied to the collector of transistor 31 and its collector is directly coupled to the base of transistor 35. Resistor 39 returns the collector of transistor 36 and the base of transistor 35 to $V_{CC}$.

Using the above described generalizations, if transistor 31 is ten times the area of transistor 12 at 300° K., about 60 mv will appear across resistor 32 and a multiple thereof across resistor 34. It will be noted that two emitter base junctions, those of transistors 33 and 36, appear in series with the voltage across resistor 34. Two diodes will produce a −4 mv/degree coefficient. Thus, resistor 34 should be 20 times the value of resistor 32 so that the emitter of transistor 35 is operated at about 2.6 volts. This will result in a fixed voltage across resistor 41, a fixed emitter current for transistor 16, and thus a fixed $V_{BE}$ for transistor 16. Transistors 35 and 36 comprise a high gain negative feedback loop around transistor 31 load circuit. The potential at the emitter of transistor 35 will therefore be well regulated against variations in supply voltage. Since the current in resistor 41 is constant, it can be seen that the current flowing in both $\Delta V_{BE}$ generators (the currents in transistors 12, 13 and 31) will be constant.

From the foregoing it can be seen that the circuit includes an active series voltage regulator based upon a second $\Delta V_{BE}$ generator reference which produces a stabilized voltage that makes the circuit substantially more immune to power supply variations than did the prior art. The circuits that develop $V_1$ and $V_2$ are therefore similarly improved in performance.

It is to be understood that while the main object is voltage regulation, temperature compensation is also shown. Furthermore, it is an easy matter to over or under compensate as desired in order to satisfy special requirements that may be imposed by the ECL circuitry. For example, if the value of resistor 15 is decreased from optimum, $V_2$ will have a negative temperature coefficient (and a positive temperature coefficient if resistor 15 is increased). Similarly resistor 25 will affect the temperature coefficient of $V_1$.

While the above description shows that the $\Delta V_{BE}$ generator produces a voltage that is related to transistor area for devices operating at equal currents, other conditions can be employed. For example, if the ten to one emitter area ratio is used and resistor 15 made twice the value of resistor 20, the current density would be twenty to one which produces a 300° K. $\Delta V_{BE}$ of about 78 mv. This gives a positive temperature coefficient of about 0.26 mv/degree for the voltage across resistor 14. If the resistors are ratioed to increase the current in transistor 12 to double that in transistor 13, it would be desirable to make transistor 19 twice as large as transistor 18 so that their current densities and $V_{BE}$ values will be equal. Clearly the circuit is subject to many ratioing and resistor value conditions which can be used to achieve a wide range of $V_1$ and $V_2$ temperature coefficients, including zero as well as positive and negative.

Figure 3A:
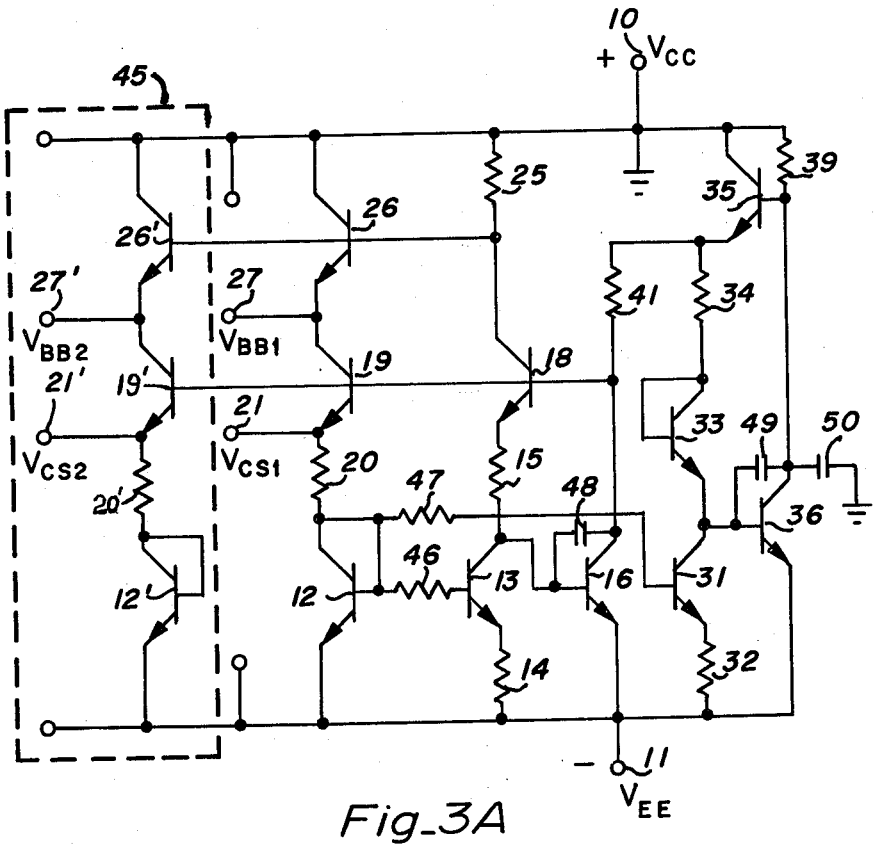
FIG. 3A is a schematic diagram of an improved version of the circuit of the invention.

FIG. 3A shows a variation on the circuit of FIG. 2. Where like parts are employed the same numbers are used. Dashed outline 45 shows a slave output stage. While only one is shown, a plurality of such stages could be employed. This slave could be used to operate a second group of ECL circuits operating independently from those connected to terminals 21 and 27. Terminals 21' and 27' produce similar potentials that are isolated from terminals 21 and 27 so that there will be no interaction. The parts duplicate the like numbered parts of the output section.

The circuit of FIG. 3A also includes resistors 46 and 47. As described above the transistor base current being only about 0.5% of collector current can be neglected. While this is largely true, wide temperature excursions can introduce second order effects that cause the temperature compensation to depart from the ideal. By simply including a small value resistor (for example about 150 ohms) the $\Delta V_{BE}$ generators can be base current corrected. This correction is mainly effective at the higher temperatures.

Capacitors 48, 49 and 50 are present in the circuit to frequency compensate the high gain amplifier portions. These parts produce the desired roll off of gain versus frequency at the higher frequencies so as to stabilize the circuit operation.

Figure 3B:
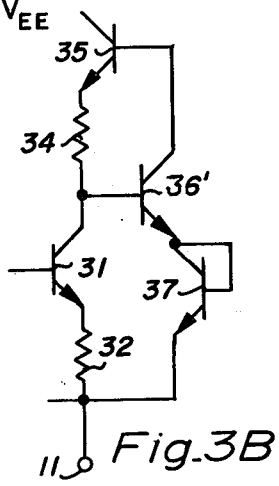
FIG. 3B is a partial schematic diagram showing an alternative circuit to a portion of FIG. 3A.
Figure 3C:
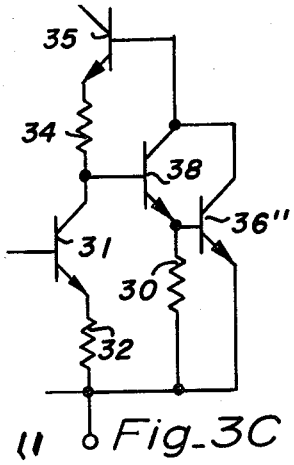
FIG. 3C is a partial schematic diagram showing another alternative circuit to a portion of FIG. 3A.

FIGS. 3B and 3C are partial schematic diagrams that show variations on the circuit of FIG. 3A and are associated with the circuitry coupled to transistor 31. In FIG. 3B transistor 36 has been replaced with transistor 36' which has a diode 37 coupled in series with its emitter. This places the collector of transistor 31 two diodes above the potential of terminal 11. Since the two diodes are in series, diode 33 is omitted and resistor 34 is directly connected to the collector of transistor 31.

In the second alternative of FIG. 3C transistor 36 is replaced with transistor 36''. Transistor 38 is coupled to transistor 36'' in the Darlington pair configuration. Resistor 30 passes a portion of the current flowing in transistor 38. This circuit also places the collector of transistor 31 two diodes above the potential of terminal 11 thus eliminating the need for diode 33. The Darlington configuration also increases the loop gain in the negative feedback stabilization circuit.

Figure 4:
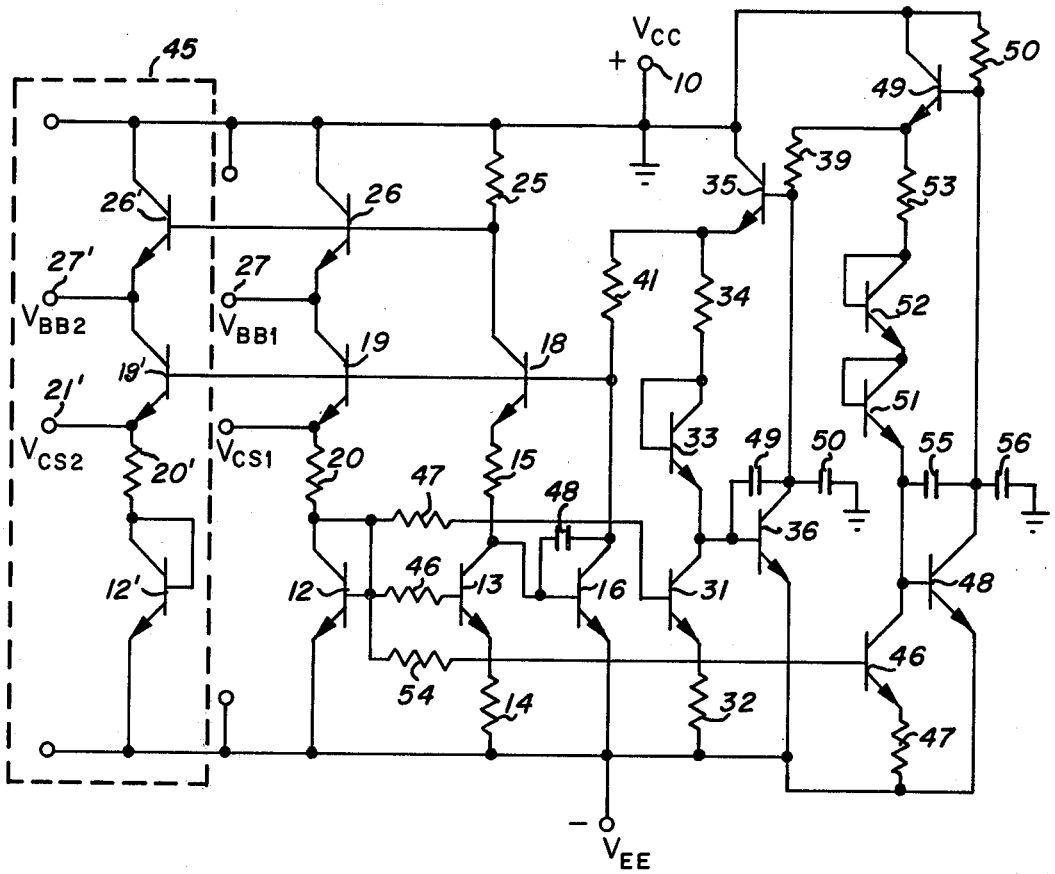
FIG. 4 is a schematic diagram of an improved version of the circuit of FIG. 3A.

FIG. 4 is a schematic diagram of a circuit similar to that of FIG. 3A except for a still further improvement in voltage regulation. In FIG. 3A it can be seen that since resistor 39 is returned to $V_{CC}$ any variation in power supply voltage will change the current flowing in resistor 39. This in turn will vary the $V_{BE}$ of transistor 36 which will produce a variation in the $V_{BE}$ of transistor 36. This in turn will produce a second order variation in the voltage regulator reference voltage at the emitter of transistor 35.

In FIG. 4, resistor 39 is returned to the emitter of transistor 49 which is a second regulated voltage reference point. This greatly reduces the effect of power supply voltage variations varying the current in transistor 36.

The second regulator is based upon a third $\Delta V_{BE}$ generator which includes transistors 12 and 46. Resistor 54 directly couples the base of transistor 46 to the base of transistor 12. Transistor 46 is operated at the lower current density so that $\Delta V_{BE}$ appears across resistor 47. Resistor 53 is ratioed with respect to resistor 47 so that a multiple of $\Delta V_{BE}$ appears thereacross. Three base emitter diodes, transistors 48, 51, and 52, are coupled in series with resistor 53 to develop a voltage reference at the emitter of transistor 49. It should be noted that if this reference is made equal to three times the extrapolated silicon band gap, the positive and negative temperature terms will cancel to a first order. Also, as before, the reference can be made over or under temperature compensated to produce almost any desired characteristic.

Transistor 48 amplifies the collector potential of transistor 46 and couples to the base of transistor 49 which provides coupling back to its emitter and thus the load circuit for transistor 46. This provides the high gain negative feedback that stabilizes the reference potential.

Resistor 50 returns the collector of transistor 48 to $V_{CC}$. Capacitors 55 and 56 act as do capacitors 49 and 50 to compensate the high gain transistor circuit.

In the circuit of FIG. 4 the effect of power supply variations has been reduced to a third order effect. Clearly, if desired, additional voltage regulator sections could be added, each one based upon another $\Delta V_{BE}$ generator. However, the benefits to be gained by going to the higher order circuits produce diminishing returns for the added circuit complexity. Thus, it is not expected that more than three $\Delta V_{BE}$ generators will be employed.

EXAMPLE

The circuit of FIG. 3 was constructed using conventional IC devices. The following component values were employed.

| Component | Value (ohms) |
|---|---|
| Resistor 14 | 38 |
| Resistor 15 | 228 |
| Resistor 20 | 100 |
| Resistor 25 | 194 |
| Resistor 32 | 38 |
| Resistor 34 | 500 |
| Resistor 41 | 400 |
| Resistor 46 | 150 |
| Resistor 47 | 150 |
| Capacitor 48 | 5 Pf. |
| Capacitor 49 | 5 Pf. |
| Capacitor 50 | 3 Pf. |

$V_{BB}$ was about 1.3 volts below $V_{CC}$ and $V_{CS}$ was about 1.3 volts above $V_{EE}$. The circuit was employed to power conventional ECL devices. The following chart compares the variation in $V_{BB}$ ($\Delta V_{BB}$) and variations in $V_{OL}$ ($\Delta V_{OL}$) as a function of power supply variations. $V_{OL}$ is the ECL logic zero level.

| | $\Delta V_{BB}$ (mv/v) | $\Delta V_{OL}$ (mv/v) |
|---|---|---|
| Prior Art Circuit | 19 | 27 |
| Figure 3 Circuit | 4 | 5 |

It can be seen that in terms of $\Delta V_{BB}$ the circuit of the invention is almost five times better than the prior art circuit and in terms of $\Delta V_{OL}$ over five times better.

The invention has been described and preferred embodiments detailed. Clearly there are alternatives and equivalents that will be within the spirit and intent of the invention. Accordingly, it is intended that the scope of the invention be limited only by the following claims.

I claim:

1. A circuit for developing a first output voltage referenced with respect to the positive terminal of a positive rail connectible to a power supply and a second output voltage referenced with respect to a negative rail connectible to the negative terminal of said power supply, said circuit comprising: means for developing a first $\Delta V_{BE}$ comprising a first pair of transistors, means for operating said first pair of transistors at different current densities, and means for subtracting the base to emitter voltage of the lower current density transistor of said first pair from the base to emitter voltage of the higher current density transistor of said first pair whereby said first $\Delta V_{BE}$ has a positive temperature coefficient of voltage;

means for developing a first multiple and a second multiple of said first $\Delta V_{BE}$;

means for developing a first negative temperature coefficient voltage and means for combining it with said first multiple to create said first voltage, said first multiple being selected so that said positive and negative temperature coefficients are nearly equal;

means for developing a second negative temperature coefficient voltage and means for combining it with said second multiple to create said second voltage, said second multiple being selected so that said positive and negative temperature coefficients are nearly equal; and means for maintaining a constant current in said means for developing a first negative temperature coefficient voltage.

2. The circuit of claim 1 wherein said means for maintaining a constant current comprises a voltage regulator.

3. The circuit of claim 2 wherein said voltage regulator comprises:

means for developing a second $\Delta V_{BE}$ comprising a second pair of transistors, means for operating said second pair of transistors at different current densities, and means for subtracting the base to emitter voltage of the lower current density transistor from the base to emitter voltage of the higher current density transistor of said second pair whereby said $\Delta V_{BE}$ of said second pair has a positive temperature coefficient of voltage;

means for developing a multiple of said second $\Delta V_{BE}$;

means for developing a third negative temperature coefficient voltage and means for combining it with said multiple of said second $\Delta V_{BE}$ to create a reference voltage, said multiple of said second $\Delta V_{BE}$ being selected so that said positive and negative temperature coefficients are nearly equal;

first voltage regulator means coupled between said positive and negative rails to create a regulated potential circuit node;

means for coupling said reference potential to said regulator whereby said regulator produces regulated potential at said node; and means for operating said first and second pairs of transistors from said node whereby said first $\Delta V_{BE}$ and said second $\Delta V_{BE}$ are substantially unaffected by variations of said power supply voltage.

4. The circuit of claim 3 wherein said first pair and said second pair of transistors employ a common higher current density transistor.

5. The circuit of claim 4 wherein said first $\Delta V_{BE}$ is developed across a first resistor and said first and second multiples are obtained from second and third resistors connected to pass a current substantially equal to the current in said first resistor whereby said multiples are obtained by means of ratioed resistor values.

6. The circuit of claim 5 wherein said second $\Delta V_{BE}$ is developed across a fourth resistor and said multiple of said second $\Delta V_{BE}$ is developed across a fifth resistor connected to pass a current substantially equal to the current in said fourth resistor whereby said multiple of said second $\Delta V_{BE}$ is obtained by ratioing said fourth and fifth resistors.

7. The circuit of claim 6 wherein said third negative temperature coefficient voltage is obtained by series connecting a pair of forward biased transistor emitter base junctions.

8. The circuit of claim 3 further comprising a third $\Delta V_{BE}$ generator, a second voltage regulator means coupled between said positive and negative rails, means for coupling a multiple of said third $\Delta V_{BE}$ generator to said second voltage regulator, to provide a reference therefor means for operating said second voltage regulator at a higher voltage than said second voltage regulator, and means for coupling said first voltage regulator to said second voltage regulator whereby the combined operation of said voltage regulators further stabilizes said first and second output voltages.

* * * * *